US005367823A

United States Patent [19]

Ferris

[11] Patent Number: 5,367,823

[45] Date of Patent: Nov. 29, 1994

[54] APPARATUS FOR CUT FLOWER STORAGE AND DISPLAY

[76] Inventor: John Ferris, 20654 Pacific Coast Hwy., Malibu, Calif. 90265

[21] Appl. No.: 114,879

[22] Filed: Aug. 31, 1993

[51] Int. Cl.[5] ..... A47G 7/00

[52] U.S. Cl. ..... 47/39; 47/41.01; 47/82

[58] Field of Search ..... 47/82, 41.01, 83, 41.11, 47/39

[56] References Cited

U.S. PATENT DOCUMENTS

| | | | |
|---|---|---|---|
| 3,452,475 | 7/1969 | Johnson, Sr. | 47/82 |
| 4,419,843 | 12/1983 | Johnson | 47/82 |
| 4,593,490 | 6/1986 | Bodine | 47/82 |
| 5,044,118 | 9/1991 | Ferris | 47/62 |

FOREIGN PATENT DOCUMENTS

| | | | |
|---|---|---|---|
| 0301362 | 2/1989 | European Pat. Off. | 47/82 |
| 2550073 | 2/1985 | France | 47/82 |

*Primary Examiner*—Ramon S. Britts
*Assistant Examiner*—Joanne C. Downs
*Attorney, Agent, or Firm*—Cooley Godward Castro Huddleson & Tatum

[57] ABSTRACT

An improved cut flower storage and display assembly is provided having a plurality of vertically spaced storage and display containers and including integral container dividers formed by the configuration of the vertically spaced containers. The assembly includes a liquid circulation system formed by discharge apertures in upper containers, a removable pump in a lowest one of the containers and a flexible liquid line connected between the pump and an uppermost container. The liquid circulation system permits easy removal of a container needing cleaning and replacement of the container needing cleaning with a clean container, so that the container needing cleaning can be cleaned remote from the apparatus.

9 Claims, 6 Drawing Sheets

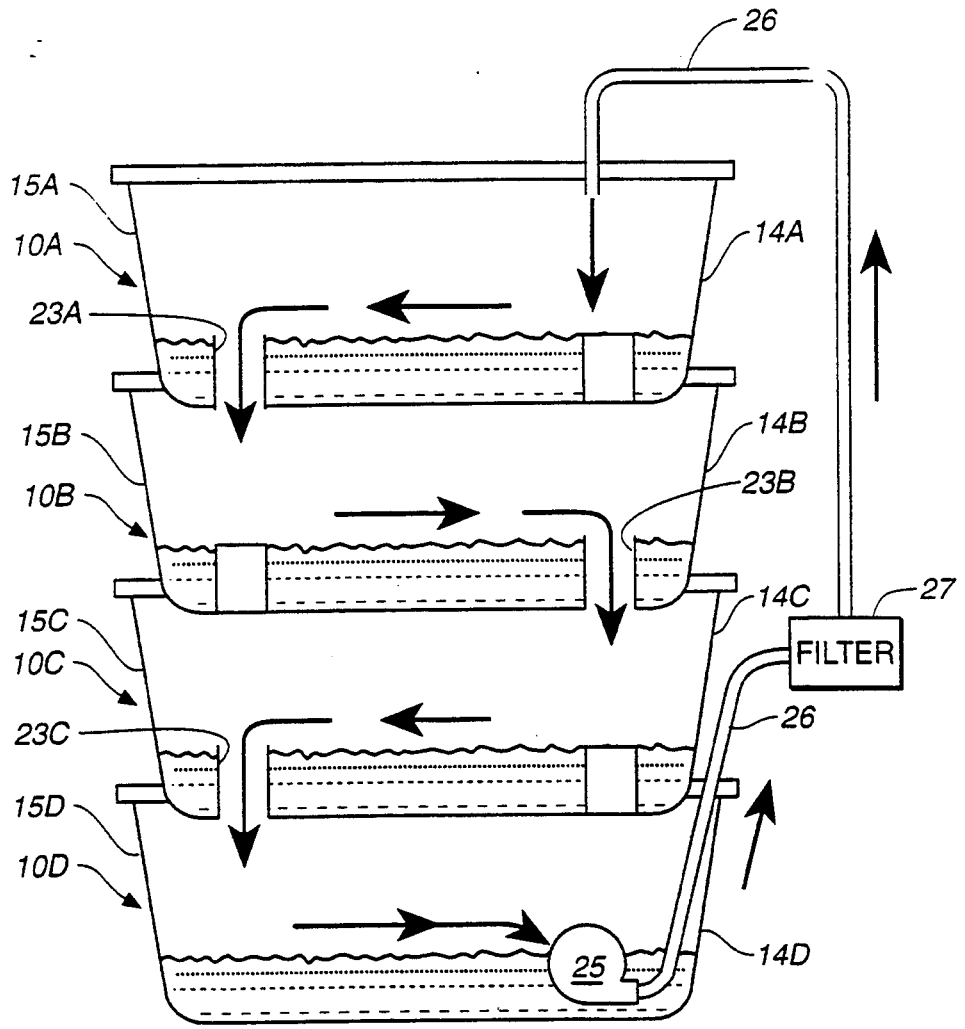
FIG._4
FIG._6
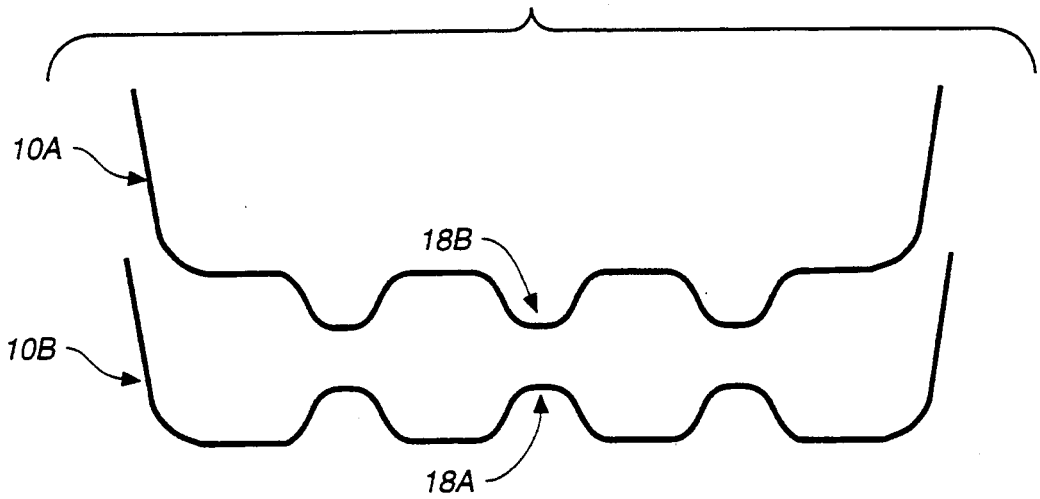

APPARATUS FOR CUT FLOWER STORAGE AND DISPLAY

TECHNICAL FIELD

This invention relates generally to an improved apparatus for providing efficient, economical storage and display of cut flowers and the like, and for prolonging the useful life of cut flowers, particularly at retail outlets. It relates more specifically to an improved liquid circulation and storage-display assembly.

BACKGROUND ART

Cut flowers offered for retail sale are conventionally stored and displayed in a plurality of individual buckets or other containers with liquid for preserving their freshness. The containers are generally arranged on the floor of the retail outlet, or on shelves for display and retail sale resulting in a cramped appearance and occupying a large amount of floor space. Despite the fact that such displays require much floor space (and can also require refrigeration) the growth rate of cut flower sales in retail outlets is substantial.

The useful lifetime of cut flowers, that is the period of time during which cut flowers maintain a fresh appearance, is limited by the rapid propagation of microorganisms in the liquid and accumulation of microorganisms in the xylem of the cut flowers. Propagation of microbes at the cut of the plant stem blocks transport of water and nutrients to the leaves and blossoms, and results in rapid deterioration in the fresh appearance of the flowers. In addition, propagation of algae in the liquid typically results in unpleasant odors, and causes deterioration.

It has been estimated that about 15% to about 20% of fresh cut flowers delivered to retail outlets are wasted and disposed of due to the deterioration in their appearance caused by the proliferation of the microbial and algal populations in the water source.

Consequently, proper maintenance of cut flowers at displays requires frequent liquid changes and container cleaning to destroy the microbial and algal populations (at least once a day). Proper maintenance is thus a labor intensive task, since cut flower containers are relatively small, and emptying, scrubbing, and refilling the many small containers in a display is time consuming and not susceptible to automation.

Soluble floral preservatives are known in the art, as are algicides. Their use can prolong the useful life of cut flowers, but it is also labor intensive, since each time the liquid is emptied and replaced in each of the containers, proper dosages of floral preservative and algicide must be added to the container and mixed with the fresh liquid. An added problem is that improper dosing can be ineffective and wasteful (dose too small) or harmful to the flowers (dose too large). Because the difference between an effective dose and a harmful dose is relatively small, the user must maintain close control over the concentration and exercise care when using containers of different sizes.

A variety of flower storage-display structures are known. Exemplary structures are disclosed in U.S. Pat. Nos.: 1,217,239, issued Feb. 27, 1917 to Schwartz; 3,293,798, issued Dec. 27, 1966 to Johnson, Sr.; 3,374,574, issued Mar. 26, 1968 to Halle; 3,447,261, issued Jun. 3, 1969 to Hundt; 3,445,055; 3,452,475 issued Jul. 1, 1969 to Johnson, Sr., issued Jul. 15, 1969 to Chute; 4,123,873, issued Nov. 7, 1978 to Canova; 4,334,387, issued Jun. 15, 1982 to Karpisek; 4,355,485, issued Oct. 26, 1982 to Frank; 4,380,136, issued Apr. 19, 1983 to Karpisek and 5,044,118 issued Sep. 3, 1991 to me.

U.S. Pat. No. 3,452,475 discloses a vertically tiered self-irrigated planter including a plurality of vertically stacked trays having peripheral annular troughs containing soil for plants. The trays are provided with annular water chambers arranged inwardly of the soil troughs and in communication with the soil troughs at their lower end portions. The vertically stacked trays are provided with overflow apertures to allow water to drip from upper to successively lower trays. Water reservoirs are also provided with water level control and water discharge means.

My U.S. Pat. No. 5,044,118 discloses a plurality of storage and display containers mounted vertically on an assembly and having an integral liquid circulation and disinfection system. During the course of working with that system it was discovered that the storage-display assembly could advantageously be improved. This invention is an improved design for that assembly.

DISCLOSURE OF THE INVENTION

The improved, cut flower storage and display container in accordance with this invention includes a plurality of trough-like containers defining a plurality of liquid reservoirs in which cut flowers or the like may be placed and provided with a continuous supply of circulating liquids. The containers are arranged in a vertically spaced relationship.

Each of the containers has a generally planar rectangular bottom surface, a continuous side wall having a lower peripheral edge joined to a peripheral edge of the bottom surface, and an upper peripheral edge having a greater circumference than the lower peripheral edge. The bottom surface and the continuous side wall define a liquid reservoir and the upper peripheral edge serves as a cut flower supporting surface. Integrally disposed in the sidewall are container dividing means comprising a first plurality of spaced-apart upper protuberances proximal to the upper peripheral edge and projecting inwardly into the reservoir and a second plurality of spaced-apart lower protuberances proximal to the lower peripheral edge projecting outwardly from the reservoir. The upper and lower protuberances form pairs of vertically arranged juxtaposed partitions separated by an aperture and defining a plurality of chambers in the reservoirs when the containers are arranged in a vertically spaced relationship. The containers are provided with liquid circulation means penetrating the liquid reservoirs to provide liquid circulation among the plurality of vertically aligned containers and maintaining a desired liquid level in each reservoir.

This arrangement obviates the need for separate partitions dividing the reservoirs and providing individual chambers to hold individual bunches of cut flowers. In the past (e.g., see my U.S. Pat. No. 5,044,118), removable partitions having numerous holes were used to accomplish that function. Such design made manufacturing difficult, increased the likelihood of damage to the apparatus in shipping and in assembly and disassembly, and potentially increased the likelihood of injury to the cut flowers since the angled partitions and holes could catch and tear the stems and other flower parts.

The containers are preferably mounted in spaced relationship on a support structure or rack to form at least one generally vertical column. Suitable stationary or movable freestanding support racks may be provided for mounting a plurality of containers in a plurality of generally vertical columns to form modular storage and display assemblies having generally rectangular, circular, or other configurations. The storage and display assemblies may be provided with casters, or the like, so that they may conveniently be moved between storage, cleaning, and display locations.

The improved cut flower storage and display assembly of this invention may optionally incorporate a liquid circulation and disinfection system including an ultraviolet disinfection unit for eliminating microbial populations, including bacteria, algae, viruses, yeasts, molds and fungi from the circulating liquid, and a pump means for conveying liquid to the uppermost container. Utilizing the liquid circulation system of the present invention, liquid may be continuously or intermittently circulated to the uppermost containers to fill the liquid reservoir of the uppermost container to a desired liquid level, whereupon liquid is discharged from the uppermost container into the liquid reservoir of the adjacent lower container until the liquid reservoir of the adjacent lower container is filled to the desired liquid level, and liquid is similarly discharged to the adjacent lower container. Liquid is thus provided to fill the liquid reservoir of each container in a column to a desired liquid level sequentially from the uppermost to the lowermost container, and excess liquid is discharged from the lowermost container. The liquid reservoir of each container remains filled to the desired liquid level as liquid is continuously or intermittently circulated through each column of storage and display containers. An air cooling system may also be provided. Such systems are disclosed in my U.S. Pat. No. 5,044,118 issued Sep. 3, 1991, the related teachings of which are hereby incorporated by reference.

BRIEF DESCRIPTION OF THE DRAWINGS

The above-mentioned and additional features of the present invention and the manner of obtaining them will become apparent, and the invention will be best understood by reference to the following more detailed description, read in conjunction with the accompanying drawings.

FIG. 4 is a schematic representation illustrating the path of water flow.

FIG. 6 is a diagramatic representation illustrating the container dividing means of the invention.

BEST MODE OF CARRYING OUT THE INVENTION

Figure 1:
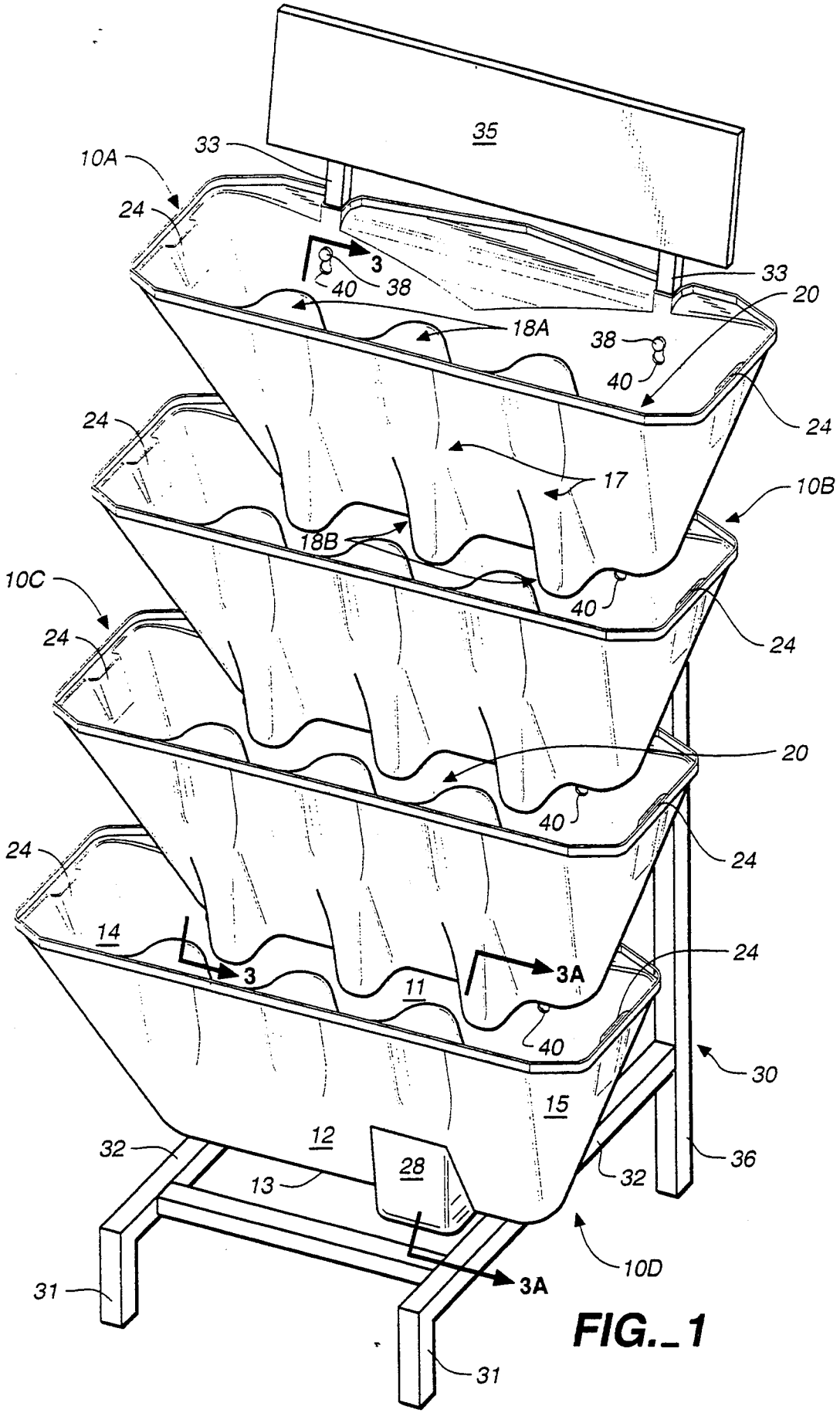
FIG. 1 illustrates a perspective view of a plurality of the cut flower storage and display containers of FIG. 2 arranged in vertically spaced relationship.
Figure 2:
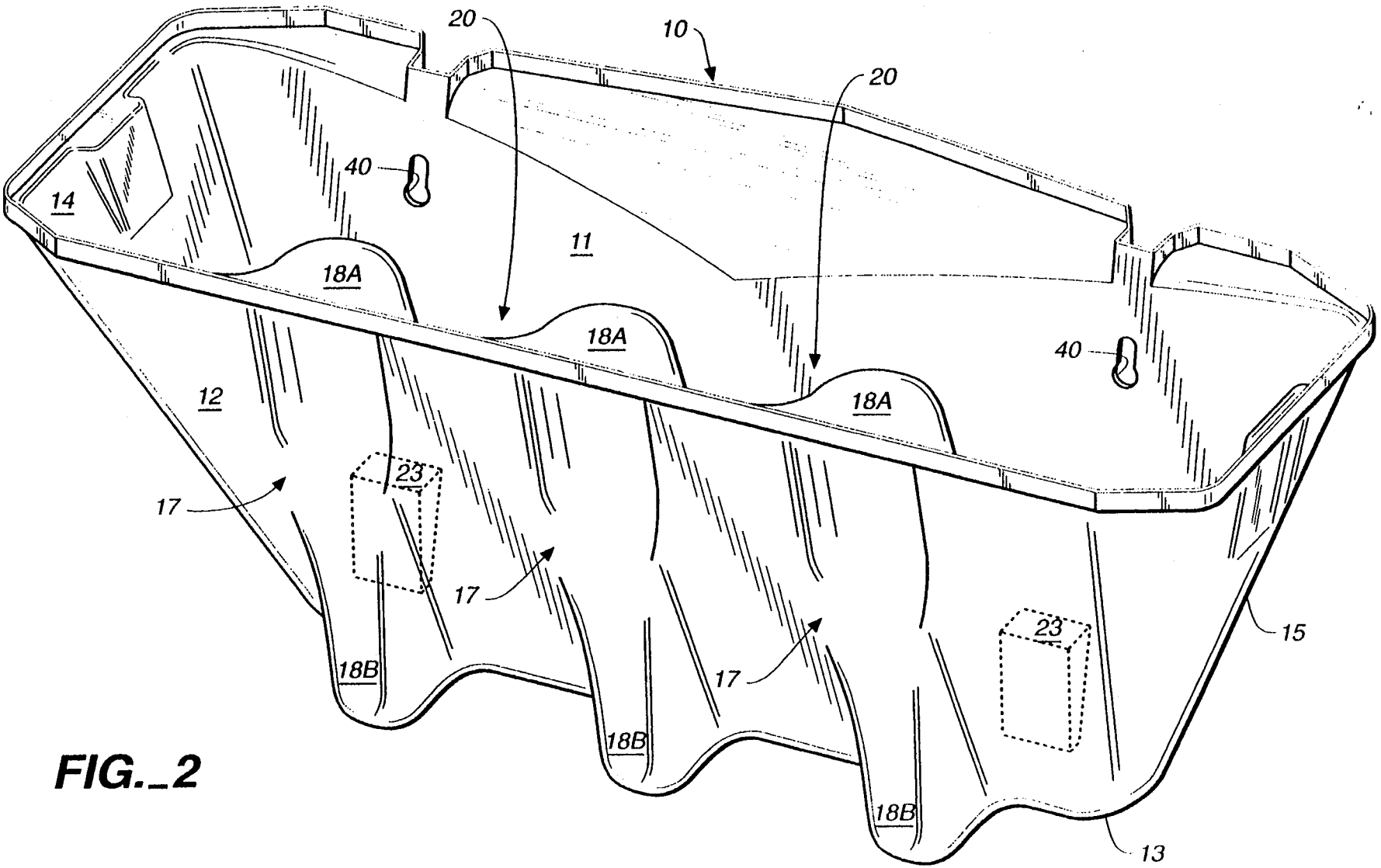
FIG. 2 illustrates a perspective view of a trough-like cut flower storage and display container in accordance with the present invention.
Figure 3:
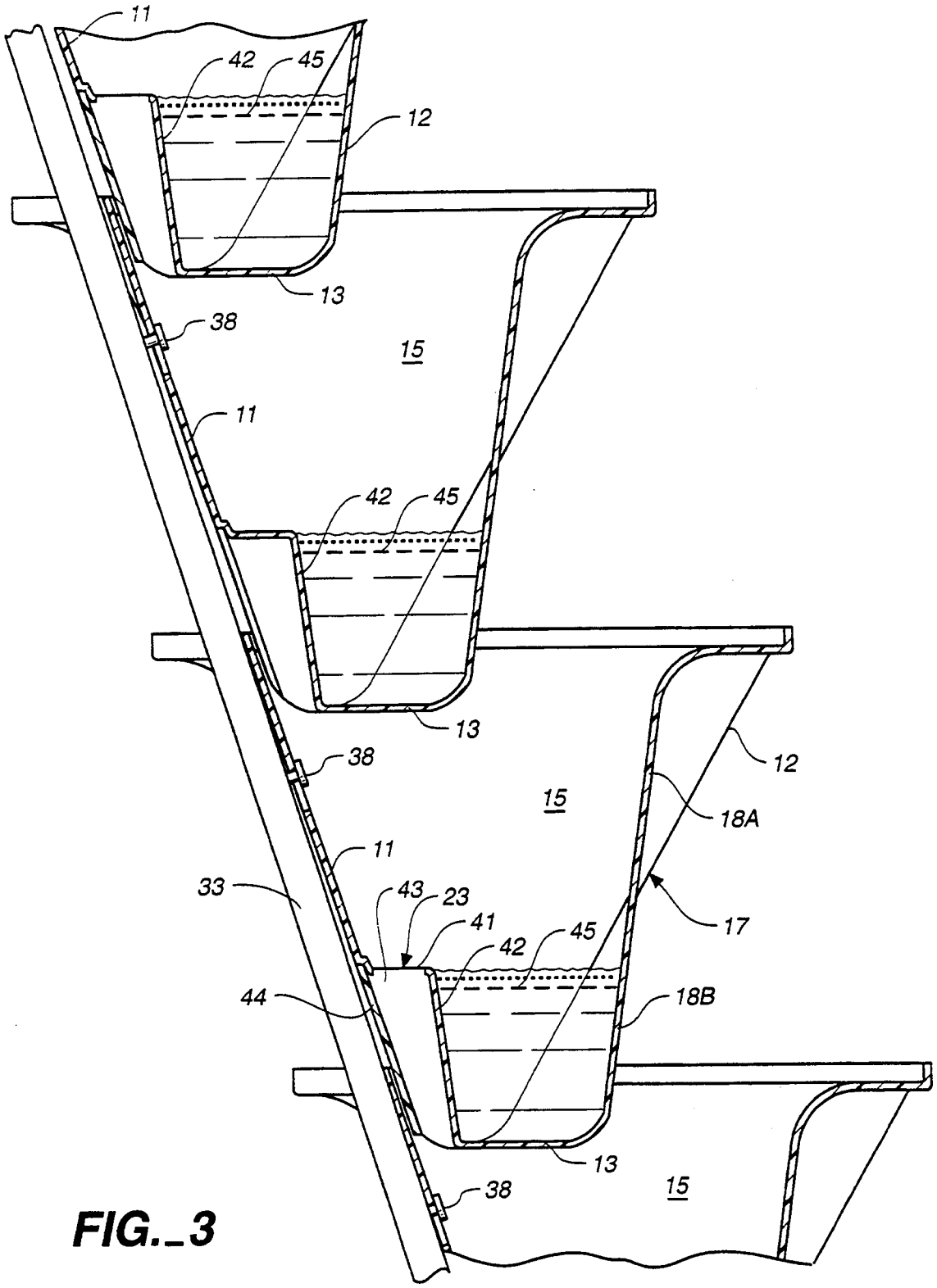
FIG. 3 illustrates a partial sectional view taken along the line 3—3 in FIG. 1.

As shown in FIGS. 1-3, trough-like cut flower storage and display container 10 includes back wall 11 and front wall 12 joined by bottom wall 13 and end walls 14 and 15 forming a continuous side wall. At least one of the back or front walls is preferably arranged at an obtuse angle with respect to bottom wall 13. For example, back wall 11 is arranged at a substantially right angle to bottom wall 13, while front wall 12 is arranged at an obtuse angle of about 100° to about 150° with respect to bottom wall 13 as best seen in FIG. 3. Trough-like container 10 provides a liquid reservoir and receptacle for storing and/or displaying fresh flowers.

Liquid circulation means 23 is preferably provided in back wall 11 of the trough-like container to facilitate liquid circulation among a plurality of containers. Liquid circulation means 23 preferably comprises a hole penetrating back wall 11 above the level of bottom wall 13 and in proximity to one of the end walls.

Container dividing means 17 are provided to divide the container into a plurality of contiguous receptacles. Container dividing means 17 are integrally formed in front wall 12 and provide discrete contiguous receptacles 20 for receiving flowers. Container dividing means 17 are arranged in spaced-apart relation to each other. They are substantially cone-shaped and configured to protrude internally into trough-like container 10 proximal to the top of front wall 12 and to protrude externally proximal to the bottom of front wall 12. More particularly, the front wall 12 of each container 10A, 10B, 10C is formed with a series of integral, vertically extending, substantially half conical pairs 18A and 18B. Half conical pairs 18A and 18B are disposed along a substantially vertical axis, are joined at their apexes and are bisected longitudinally. Half cone 18A is the inverted minor image of half cone 18B, thereby resulting in inwardly extending protuberances proximal the top front wall 12 and outwardly extending protuberances proximal the bottom of front wall 12. By arranging the plurality of containers congruently, the inwardly extending upper protuberances of one container and outwardly extending lower protuberances of the container above it together form and function as an apertured container divider, dividing the interior of each container (except the uppermost) into a series of chambers having a transverse passageway extending from the top of front wall 12 to the bottom of back wall 11. See FIGS. 1 and 5. (While not shown in FIGS. 1 or 5, bottom container 10D could also be formed with outwardly extending lower protuberances.) Perhaps these features can be better understood with reference to FIG. 6, the diagramatic representation illustrating, in an exaggerated format, the container dividing means described above. FIG. 6 illustrates that by arranging containers 10A and 10B congruently, half cones 10A and 10B form a series of apertured dividers, in effect separating the containers into a series of chambers. This arrangement provides an unimpeded liquid flow path and provides contiguous receptacles 20 for keeping the individual bunches of flowers in separate and substantially upright position. Containers 10 are optionally provided with integral handles 24 in side walls 14 and 15 to ease transport and cleaning.

Figure 3A:
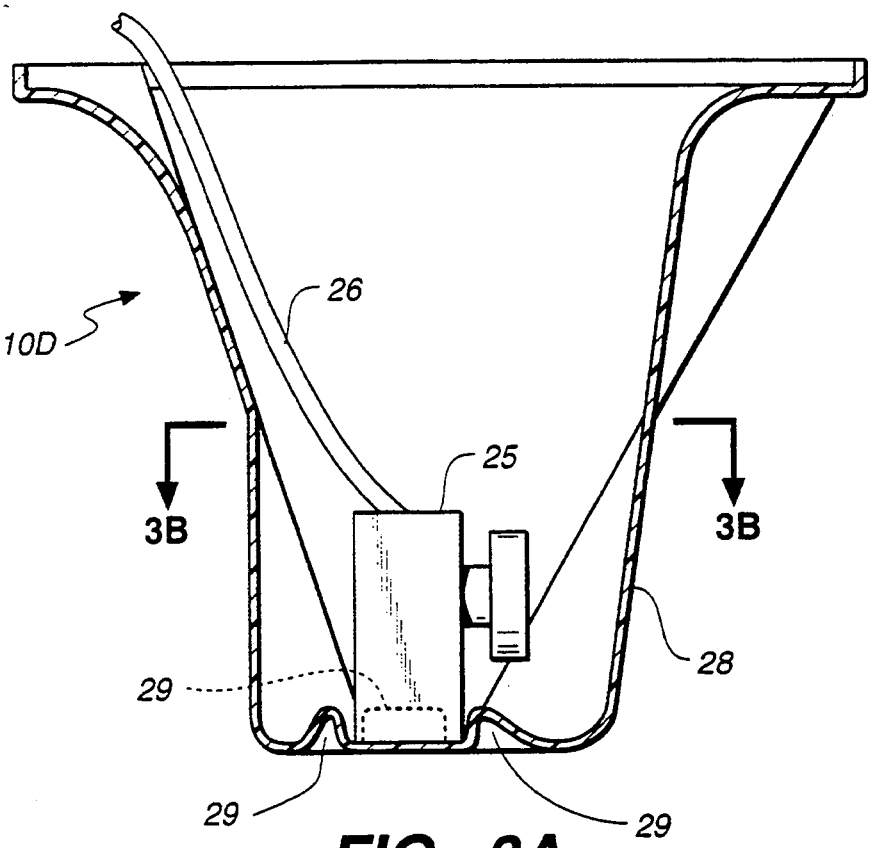
FIG. 3A is a partial sectional view taken along the line 3A—3A in FIG. 1.
Figure 3B:
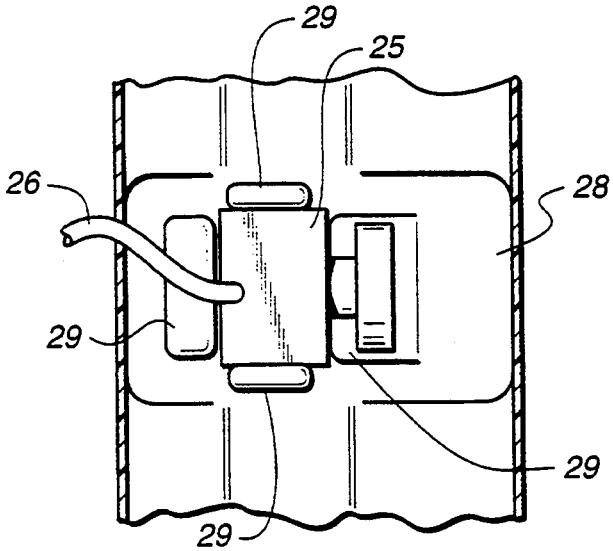
FIG. 3B is a partial sectional view taken along the line 3B—3B in FIG. 3A.
Figure 5:
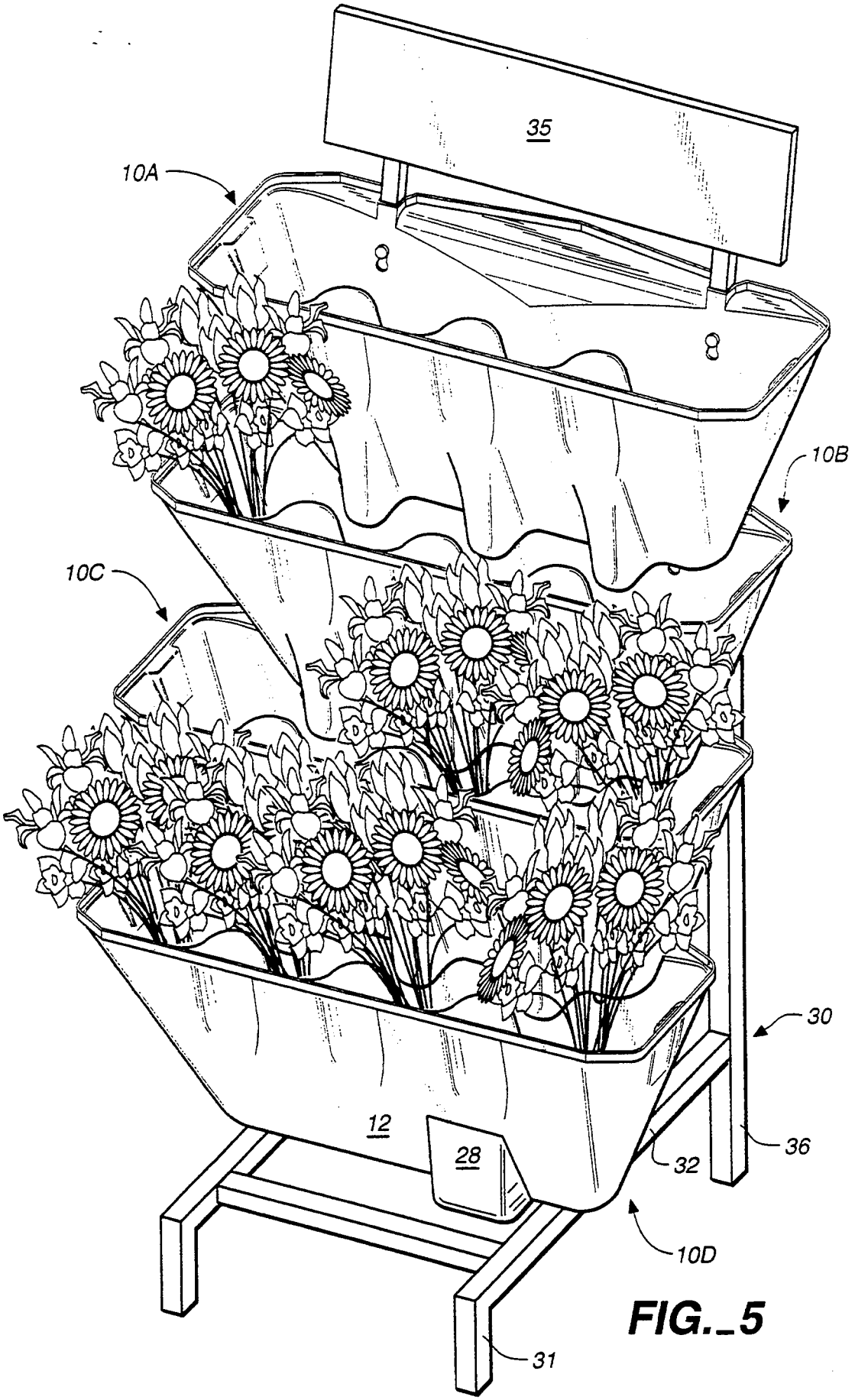
FIG. 5 is the same view as FIG. 1, illustrating the invention in use.

FIGS. 1 and 5 illustrates a cut flower storage and display assembly utilizing a plurality of the containers of FIG. 2 mounted on a support surface and arranged in vertically aligned relationship. This assembly is adapted for use with a liquid circulation system whereby liquid is provided to container 10A, and is circulated through containers 10B, 10C, and 10D sequentially. As shown schematically in FIG. 4, liquid circulation means of vertically adjacent containers are preferably located adjacent opposite side walls of the containers. For example, liquid discharge means 23A is provided in proximity to end wall 15A of container 10A, while liquid discharge means 23B is provided in proximity to end wall 14B of container 10B. Container 10C is likewise provided with liquid discharge means 23C in proximity to end wall 15C. Bottom container 10D is provided with pump holding enclosure 28 (see FIGS. 1, 3A and 3B) integrally formed inside wall 12 adjacent to bottom wall 13. The pump holding enclosure 28 has projections 29 which extend into the enclosure 28 from the walls 12 and 13 to capture removable pump 25 loosely. The pump 25 is connected to flexible plastic water line 26 arranged to extend from bottom container 10D to top container 10A (see also FIG. 4), providing a means of liquid transfer from one to the other and completing the liquid circulation system. Optionally, a filter 27 may be arranged in line with water line 26 to filter the liquid 45 discharged from container 10D. An ultraviolet light disinfection unit (not shown) could also be provided in line with water line 26 for disinfection of the liquid discharged from container 10D, as more fully described in my above referenced U.S. Pat. No. 5,044,118.

As best seen in FIG. 3, preferably liquid discharge means 23 is integrally formed in back wall 11 and comprises shoulder 41 horizontally disposed in relation to back wall 11 and back wall extension 42, which is an offset portion of vertically extending back wall 11, disposed between and connecting shoulder 41 and bottom 13. Shoulder 41 contains port 43 which functions to allow circulation of liquid between containers by providing a passageway there between. The liquid circulation means is optionally provided with cover plate 44 demountably attached to back wall 11 and extending from shoulder 41 to bottom 13 to provide added stability to the container assembly. In this fashion, a plurality of storage and display containers arranged in a vertical column is sequentially filled with liquid 45 to the desired liquid level. A steady-state system may thus be established for circulating liquid through liquid reservoirs of a plurality of vertically arranged storage and display containers. Liquid circulation may be provided continuously or intermittently according to the system of the present invention. This arrangement promotes circulation of liquid through the contiguous receptacles and establishes a preferred liquid flow pattern.

Trough-like storage and display containers 10 may be mounted on the walls of a refrigerated cooler to store cut flowers, or they may be mounted on a stationary or movable support structure in a retail outlet to display cut flowers for sale. As shown in FIGS. 1 and 5, support structure 30 may optionally be provided, having a pair of upright vertical front legs 31 connected to a pair of horizontally disposed container seats 32, which in turn are connected to a pair of upright vertical back support legs 36. Container support legs 33 extend at an appropriate angle between the top of back support legs 36 and container seats 32. Container support legs 33 are conveniently provided with hooks 38 from which to hang container 10 at the upper peripheral edge of the back wall 11, which is disposed in proximity to container support legs 33. Accordingly, containers 10 are provided with attachment means for attaching container 10 to the supporting structure comprising pairs of holes 40 in back wall 11 proximal the top edge thereof. For stability, bottom brace 34 connecting the pair of container seats 32 is optionally provided. Also for stability and optionally to provide a place for advertising or labeling of the display top brace 35 connecting back legs 33 is provided, as is seen in FIGS. 1 and 5. Wheels can be added to make the assembly readily movable.

The configuration of the liquid circulation system as described above allows easy removal of containers 10 for cleaning and replacement of the containers with clean containers without requiring substantial effort to disassemble the liquid circulation system. The cleaning operation can thus be carried out remote from the display and storage apparatus, with only a momentary interruption in its operation for the replacement of a dirty container 10 with a clean container. The receptacle 28 holds the pump 25 in a desired predetermined position and orientation, secure against movement by customers during removal of cut flowers from the display and storage apparatus.

Alternatively, it may be desirable to hang containers to a wall or other similar vertical support. In that case, holes 40 can be used to hang containers 10 on other supporting structures, which can be readily constructed as is known in the art. Although the storage and display assemblies illustrated use four vertically aligned containers, it is readily apparent that a plurality of storage and display containers, and preferably from about two to about eight containers, may be utilized in a suitably designed storage and display support means. The cut flower storage and display containers and assemblies of the present invention provide high density storage and display of cut flowers and the like, which provides more efficient use of expensive cooler space and retail sales space in a store. The storage and display assemblies of the present invention provide substantially increased storage and display capacity per unit surface area.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An improved cut flower storage and display assembly having a plurality of generally trough-shaped containers defining a plurality of liquid reservoirs and arranged in a vertically spaced relationship, each of said cut flower storage and display containers having liquid circulation means for circulating liquids within said liquid reservoirs for facilitating liquid circulation among said plurality of containers, each of said cut flower storage and display containers having a generally planar rectangular bottom surface, a continuous side wall having a lower peripheral edge joined to a peripheral edge of said bottom surface and an upper peripheral edge having a greater circumference than said lower peripheral edge, said bottom surface and said side wall defining said liquid reservoir and said upper peripheral edge serving as a cut flower supporting surface, wherein the improvement comprises:

at least one of said plurality of containers having container dividing means integrally disposed in a front portion of said side wall and comprising a first plurality of spaced-apart inwardly projecting upper protuberances in said side wall proximal said upper peripheral edge and a second plurality of spaced-apart outwardly projecting lower protuberances in said side wall proximal said lower peripheral edge, said first and second plurality of inwardly and outwardly projecting protuberances forming pairs of vertically arranged, juxtaposed, apertured partitions defining a plurality of chambers in said plurality of liquid reservoirs when said containers are arranged in a vertically-spaced congruent relationship.

2. An assembly according to claim 1, wherein each of said pairs of protuberances comprises two substantially half cone-shaped structures disposed along a vertical axis and joined at the apex thereof, each member of said pair being bisected longitudinally and being the mirror image of the other.

3. An assembly according to claim 2, additionally comprising liquid discharge means in each of said plurality of containers, said liquid discharge means including at least one aperture in said container side wall.

4. An assembly according to claim 3, additionally comprising a pair of integral handles disposed in said side walls in opposed relation to each other.

5. An assembly according to claim 4, additionally comprising a supporting structure including a pair of upright vertical supports arranged in spaced-apart relation to each other in proximity to said upper peripheral edges of said containers for maintaining said containers in said vertically aligned relationship.

6. An assembly according to claim 5, wherein each of said containers additionally includes attachment means for mounting said containers to said supporting structure.

7. An assembly according to claim 1, in which said liquid circulation means includes liquid discharge means in upper ones of said plurality of containers, said liquid discharge means including at least one aperture in said container side wall.

8. An assembly according to claim 7 in which said liquid circulation means further includes a removable pump in a lowest one of said plurality of containers and a flexible liquid line connected between said removable pump and an uppermost one of said plurality of containers.

9. An assembly according to claim 8 in which said lowest one of said plurality of containers includes a pump holding enclosure adjacent said bottom surface, said pump holding enclosure including a plurality of projections for holding said removable pump in a predetermined position and orientation.

* * * * *